United States Patent [19]

Berfield et al.

[11] Patent Number: 4,658,458

[45] Date of Patent: Apr. 21, 1987

[54] ROTARY BRUSH SWEEPER WITH MECHANISM FOR BRUSH HEIGHT ADJUSTMENT

[75] Inventors: Robert C. Berfield, Jersey Shore; R. Lent Crevling, Jr., Williamsport; Ronald F. Meland, Muncy; Richard M. Fegan, Cogan Station, all of Pa.

[73] Assignee: Shop-Vac Corporation, Williamsport, Pa.

[21] Appl. No.: 852,408

[22] Filed: Apr. 16, 1986

[51] Int. Cl.[4] ..... A47L 11/22; E01H 1/04

[52] U.S. Cl. ..... 15/49 C; 15/41 R; 15/42; 15/79 R; 15/87

[58] Field of Search ..... 15/49 C, 50 C, 79 R, 15/79 A, 82, 83, 383, 41 R, 41 A, 42

[56] References Cited

U.S. PATENT DOCUMENTS

| | | | |
|---|---|---|---|
| 27,839 | 4/1960 | Smith . | |
| 71,894 | 12/1967 | McConnell et al. . | |
| 553,029 | 1/1896 | Graham . | |
| 696,443 | 4/1902 | Hoppes | 15/79 R |
| 720,474 | 2/1903 | Pike . | |
| 2,689,367 | 9/1954 | Parker | 15/49 C |
| 4,071,920 | 2/1978 | Block | 15/49 C |
| 4,366,593 | 1/1983 | Parikh | 15/49 C |

FOREIGN PATENT DOCUMENTS

| | | | |
|---|---|---|---|
| 698189 | 10/1953 | United Kingdom | 15/79 R |
| 765671 | 1/1957 | United Kingdom | 15/79 R |

*Primary Examiner*—Edward L. Roberts

*Attorney, Agent, or Firm*—Ostrolenk, Faber, Gerb & Soffen

[57] ABSTRACT

A rotary brush sweeper includes a rotary brush which is rotatable about a brush axis and which may be of generally cylindrical form. The rotary brush is supported in a brush support assembly that is pivotable about a central axis, with the brush axis being offset from the central axis. As a result, rotation of the pivotable brush support assembly accomplishes the raising or lowering of the rotary brush with respect to a surface being cleaned. In a preferred configuration, the pivotable brush support assembly includes a pair of spaced support members having respective annular convex mounting surfaces. The spaced support members are received within respective annular concave mounting surfaces situated on a housing structure for the sweeper.

18 Claims, 15 Drawing Figures

120
122
124
24
28
106
104
102
11
100
17
17a
17b
108
110
121
98

ROTARY BRUSH SWEEPER WITH MECHANISM FOR BRUSH HEIGHT ADJUSTMENT

FIELD OF THE INVENTION

The present invention relates to a rotary brush sweeper, and more particularly relates to a rotary brush sweeper with an adjustment mechanism for changing the brush-to-ground height of the rotary brush.

BACKGROUND OF THE INVENTION

Rotary brush sweepers are known, and typically include a rotary brush comprised of bristles protruding radially outward from a generally cylindrical hub. The rotary brush is typically driven from one of the wheels of the sweeper, to which the brush is mechanically coupled. The wheel which supplies mechanical power to drive the rotary brush, constituting a drive wheel, may derive its power from manual movement of the sweeper by an operator, or may be powered with an electric motor, for example.

The bristles of the rotary brush become shorter with age due to wear. It, accordingly, would be desirable to provide a height adjustment mechanism for the rotary brush, so that a desired pressure may be maintained between the bristles and a surface being cleaned. Additionally, as surface conditions change, it may be desirable to apply more or less pressure of the rotary brush bristles to the surface. Operation of the height adjustment mechanism in an easy manner is desirable to permit height adjustment on a frequent basis.

SUMMARY OF THE INVENTION

It would be desirable to provide a height adjustment mechanism for a rotary brush that is simple in construction and inexpensive to manufacture.

A further object of the invention is to provide a rotary brush sweeper having a height adjustment mechanism for the rotary brush that is easy and convenient to use.

Another object of the invention is to provide a rotary brush sweeper having a brush height adjustment mechanism which includes an easily viewable indicator of what height the brush has been set.

These and further objects of the invention are attained in a rotary brush sweeper which includes a pivotable brush support assembly. The brush support assembly includes a pair of spaced support members having respective, outwardly facing, annular mounting surfaces. The brush support assembly supports the rotary brush with the brush axis in an offset position relative to a central axis passing through the spaced support members. Accordingly, pivotal movement of the brush support assembly about the central axis raises or lowers the rotary brush with respect to the central axis. The rotary brush sweeper further includes a housing having a pair of inwardly facing annular mounting surfaces for respectively receiving the pair of outwardly facing annular mounting surfaces of the pivotable brush support assembly.

In a preferred embodiment of the invention, the pivotable brush support assembly includes an axle means with first and second wheel support portions protruding outwardly from the brush support assembly along the central axis thereof. First and second wheels are preferably mounted on the first and second wheel support portions, respectively. A height adjustment means is provided and includes an offset axle member connected to the first and second wheel support portions. The offset axle member is integrally joined to the brush support assembly so as to be pivotable therewith about the central axis. A pivot means is provided for pivoting the offset axle portion with respect to the housing and thereby pivoting the brush support assembly and changing the brush height. The pivot means comprises a coupling member coupled to the offset axle portion, and means to move the coupling member in arcuate fashion about the central axis.

It is especially preferred that the means for moving the coupling member comprise a threaded shank, and that the coupling member includes a threaded aperture for receiving the threaded shank. The coupling member advantageously comprises two separable portions that may be conveniently placed at any desired position on the threaded shank and connected together.

BRIEF DESCRIPTION OF THE DRAWINGS

The above objects as well as other objects of this invention will become readily apparent in view of the following description of the accompanying drawings, in which.

DETAILED DESCRIPTION OF THE PREFERRED EMBODIMENTS

Figure 1:
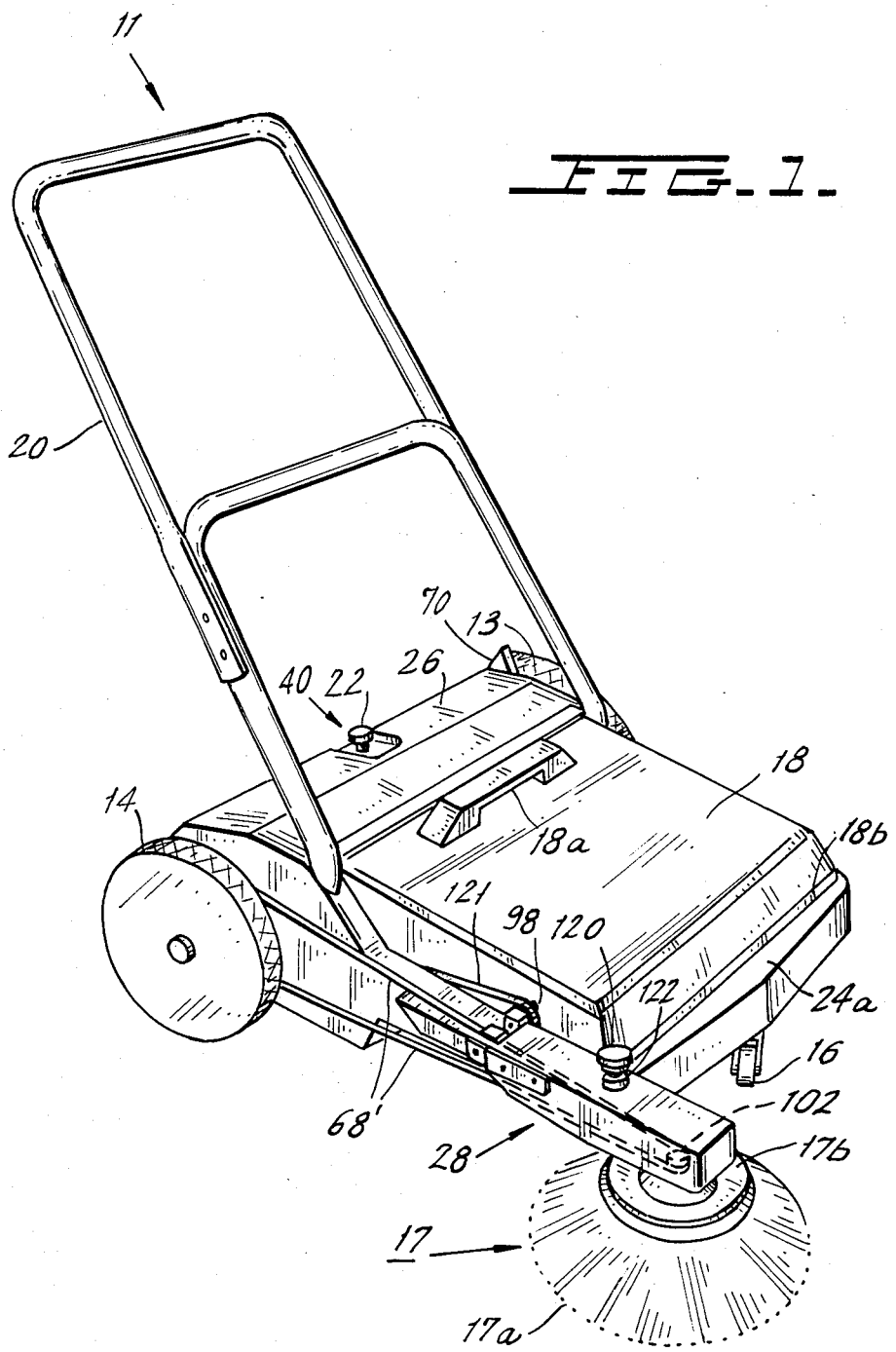
FIG. 1 is a perspective view of a rotary brush sweeper, which also includes an auxiliary rotary brush, in accordance with the present invention.

FIG. 1, shows a rotary brush sweeper 11 in accordance with the invention. Sweeper 11 includes a pair of rear wheels 13, 14 and a front wheel 16. Wheel 16 is free to pivot about a caster coupling. Sweeper 11 includes two different types of rotary brushes. Visible in the foreground of FIG. 1 is an auxiliary rotary brush 17. A further rotary brush that cannot be seen in FIG. 1 is located generally between rear wheels 13 and 14. Brush 17 includes bristles 17*a* that protrude radially outwardly from a hub portion 17*b*. Bristles 17*a* are directed downwardly towards a surface to be cleaned. Sweeper 11 includes a debris pan 18 and an operator handle 20.

In accordance with an important feature of the present invention, a height adjustment knob 22 is provided to vary the height of the rotary brush (not shown in FIG. 1) situated between rear wheels 13 and 14. A guide tab 70 is included to provide an easily viewable indication of brush height.

Figure 2:
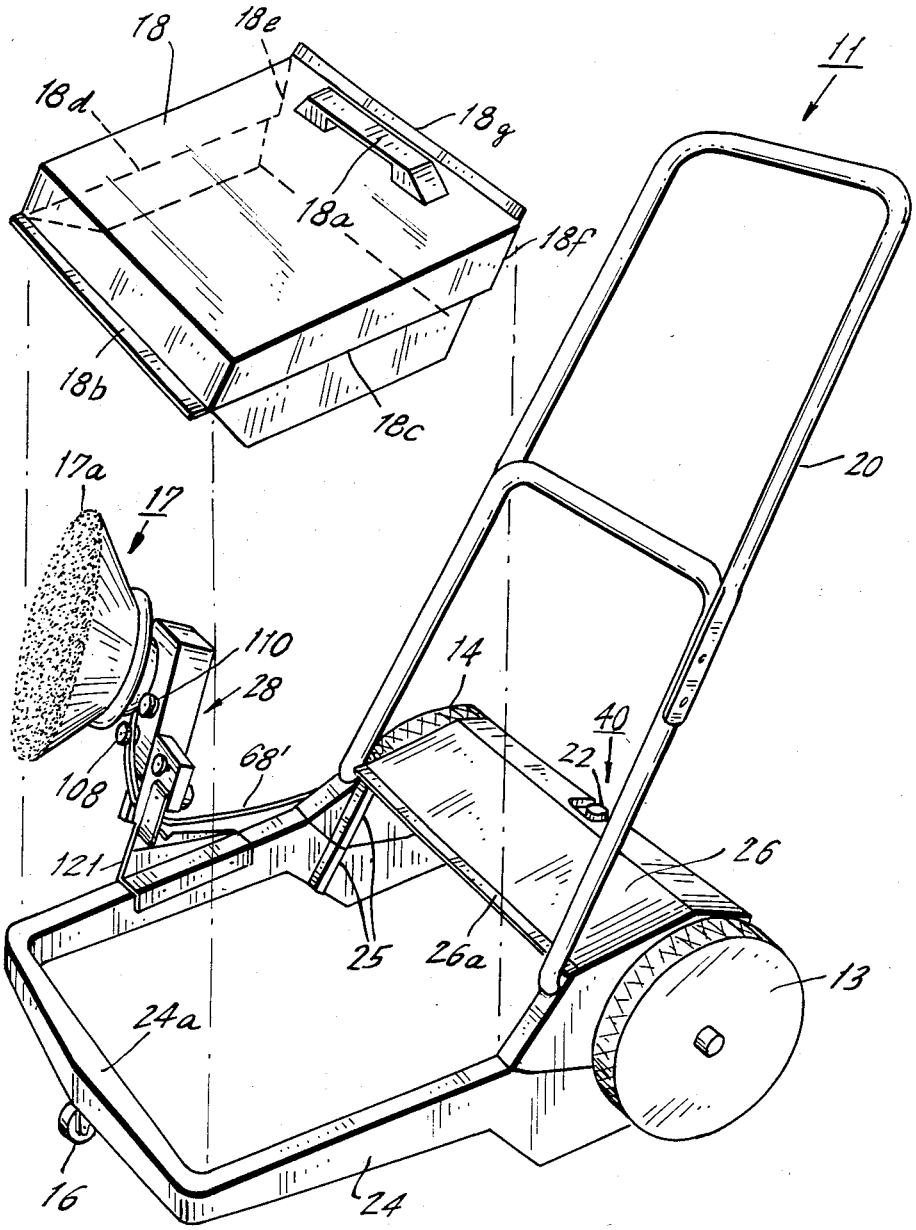
FIG. 2 is a perspective view of the sweeper of FIG. 1 illustrating how a debris container may be lifted from the body of the sweeper, and also showing how the auxiliary rotary brush may be pivoted out of contact with the surface being cleaned.

In the exploded view of sweeper 11 shown in FIG. 2, debris pan 18 is illustrated as lifted above housing frame 24. Debris pan 18 normally rests atop housing frame portions 24 and 26. Specifically, support portions 18*b*, 18*c* and 18*d* of the debris pan rest on surface 24*a* of lower frame portion 24; and rear portion 18*e* of the pan rests on ledge 25, formed on housing frame portions 24 and 26. Rear portion 18*f* of the pan rests on a corresponding ledge (not shown) on frame portions 24 and 26 on the opposite side of the sweeper. Rear portion 18*g* rests on seal member 26*a* of upper frame portion 26.

Additionally shown in FIG. 2 is auxiliary side brush 17 in an upraised position. Brush 17 is permitted to move upwardly due to the pivotable nature of a bracket assembly 28, which is discussed in more detail below. Accordingly, side brush 17 may move upwardly upon striking an obstacle to prevent it from sustaining damage.

Figure 3:
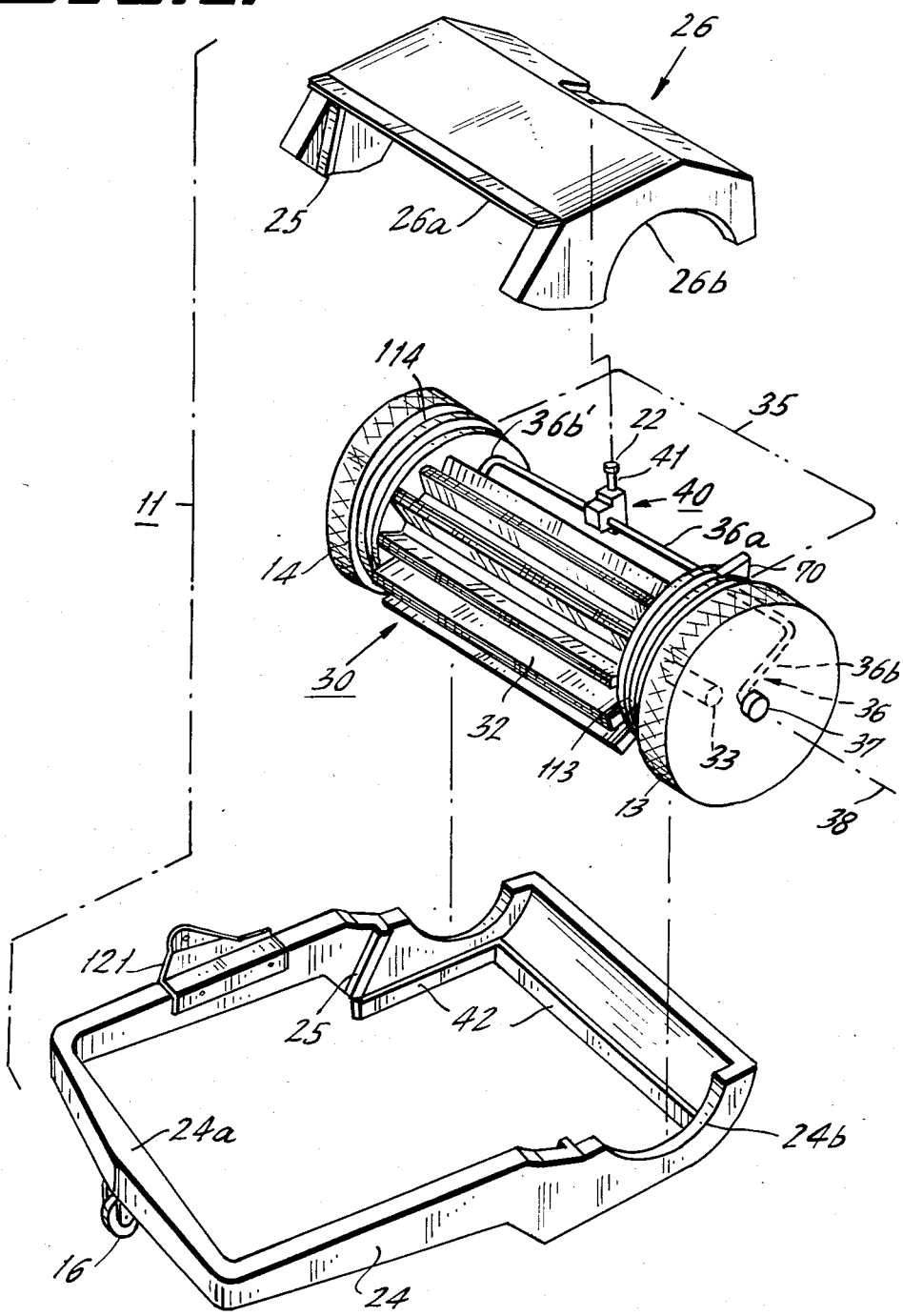
FIG. 3 is an exploded perspective view of selected parts of the rotary brush sweeper of FIG. 1 and illustrates upper and lower housing members and a pivotable brush support assembly situated between the upper and lower housing members.

The main rotary brush of sweeper 11 is shown in FIG. 3 and generally designated 30. Rotary brush 30 is comprised of bristles 32 that extend radially outwardly, in a generally cylindrical fashion, with respect to an axis centered in brush axle 33.

Rotary brush 30 is included in a brush support assembly, generally designated 35, which supports brush 30. Assembly 35 includes axle ends, such as 37, on which rear wheels 13 and 14 are mounted. In accordance with an important feature of the invention, brush support assembly 35 includes end members 113 and 114 situated adjacent wheels 13 and 14, respectively. Axle portion 36*a* is offset from a central axis 38 of assembly 35 passing through axle portion 37. Offset axle portion 36*a* is integrally joined to axle portion 37 via connecting segment 36*b*, and to the corresponding axle portion (not shown) on which wheel 14 is mounted, via axle portion 36*b*'. Support members 113 and 114 are fixedly connected to axle portions 36*b* and 36*b*', respectively, so that pivotal movement of axle portion 36*a* about central axis 38 results in corresponding pivotal movement of support members 113 and 114 about the central axis.

A pivot mechanism 40 is provided in coupled relation to offset axle portion 36*a*, and preferably includes a threaded shank 41 on which knob 22 is affixed. Knob 22 is normally accessible from above upper housing assembly 26. As will hereinafter become more apparent, the clockwise or counterclockwise movement of knob 22 causes pivotal movement of brush support members 113 and 114 about central axis 38. This, in turn, raises or lowers brush 30, since the axle 33 of brush 30 is eccentric to (i.e. offset from) central axis 38.

As can be further appreciated from FIG. 3, lower and upper housing members 24 and 26 include concave surfaces 24*b* and 26*b*, respectively, on the front-illustrated side of sweeper 11. Surfaces 24*b* and 26*b* face inwardly toward central axis 38 and are configured to mate with the outwardly facing convex surface of support member 113. The rear-illustrated side of sweeper 11 is symmetrical to the front-illustrated side of the sweeper in this regard.

FIG. 3 additionally shows flexible dust guards 42 which aid in directing dust agitated by rotary brush 30 into debris pan 18 (FIG. 2).

Figure 4:
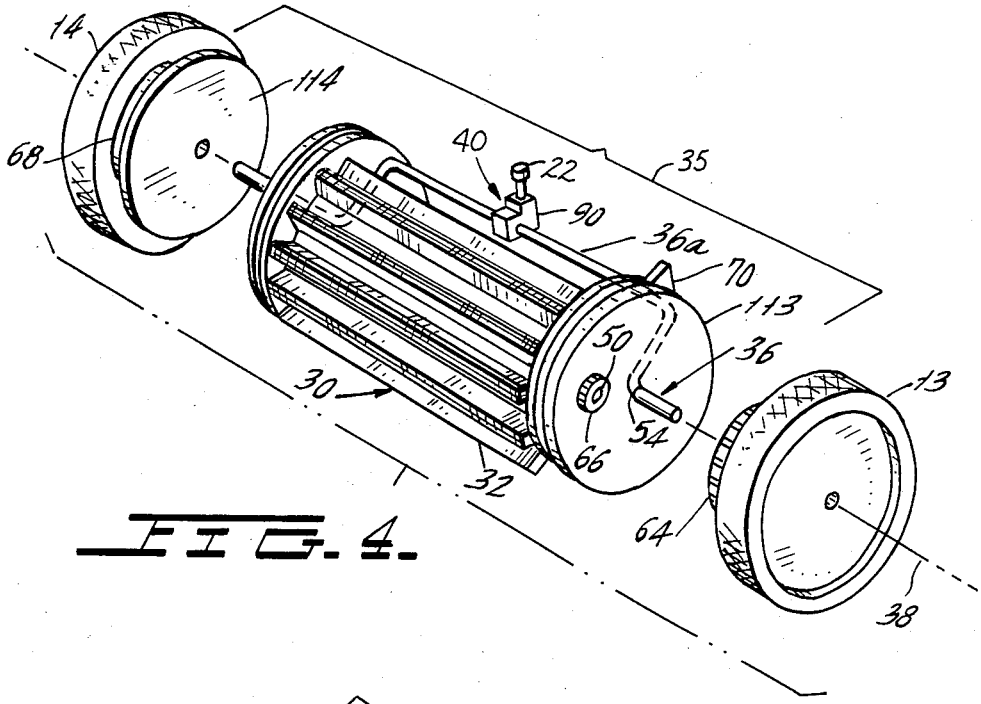
FIG. 4 is a perspective view of the pivotable brush assembly and rear wheels shown in FIG. 3, with the rear wheels separated from the brush support assembly.
Figure 5:
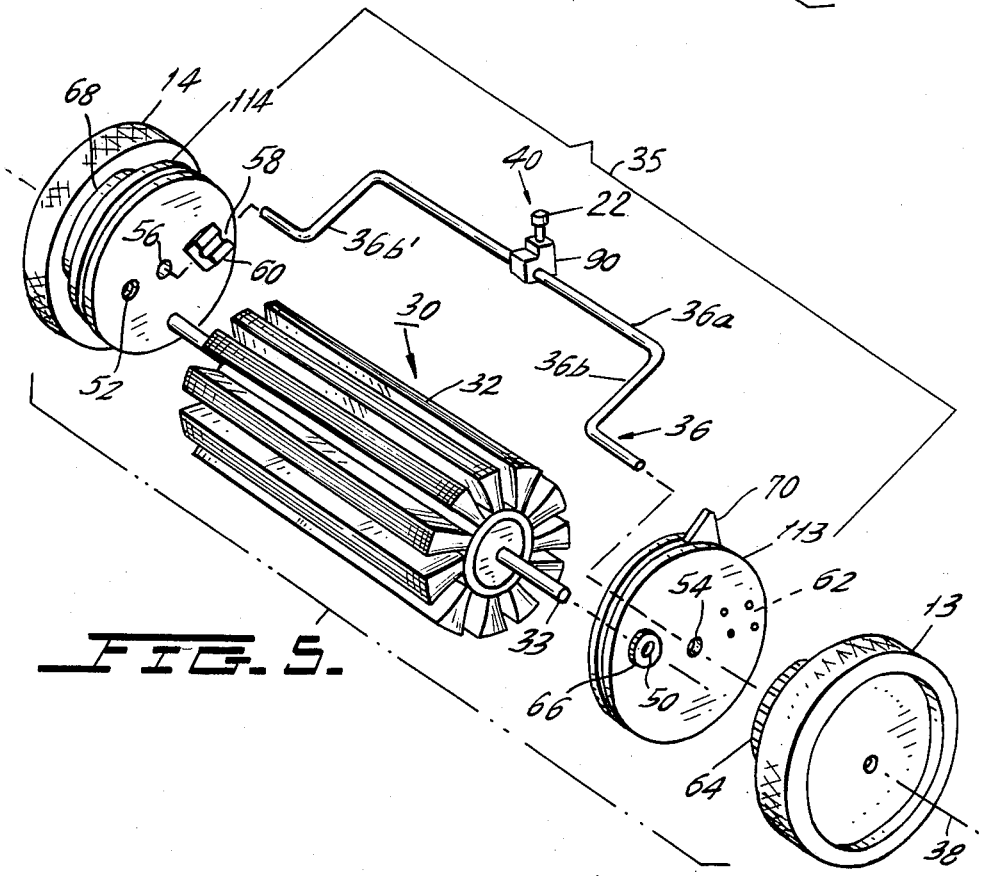
FIG. 5 is an exploded view of the brush support assembly of FIG. 4.

FIG. 4 shows rotary brush assembly 35 and rear wheels 13 and 14, which are shown as separated from the assembly. FIG. 5 shows an exploded view of rotary brush assembly 35 and rear wheels 13 and 14. Referring to FIGS. 4 and 5, rotary brush 30 can be seen positioned between brush end members 113 and 114. Axle 33 of rotary brush 32, as viewed in FIG. 5, is normally mounted at its right-hand end in bearing support 50, while the left-hand end of axle 33 is supported in bearing 52. As will be described more fully hereinafter, bearing 50 includes a one-way clutch so that rotary brush 32 is caused to spin only in one direction. This facilitates the sweeping of dust into the dust pan described above. Bearing 52 may be a simple bearing.

FIG. 5 illustrates how offset portion 36*a* of axle 36 provides room for rotary brush 30 to be contained compactly between end support members 113 and 114. The right-hand illustrated end of axle 36 passes through aperture 54 in end support member 113. Similarly, the left-hand illustrated end of axle 36 passes through aperture 56 in end support 114. As best shown in FIG. 5, left-hand illustrated portion 36*b*' of axle 36 is fixed against rotation about axis 38 relative to end support 114 by being fixedly received in slot 58 in a mounting member 60. Mounting member 60 is affixed to end support member 114. A similar arrangement, generally designated 62, is provided on right-hand illustrated end member 113 for fixing the location of axle part 36*b* relative to end member 113.

FIGS. 4 and 5 illustrate further features of the invention. Ring gear 64 and pinion gear 66 are shown, which provide a drive mechanism for rotary brush 30. Gears 64 and 66 are described in more detail below. Between rear wheel 14 and adjacent end support member 114 is shown a pulley 68, used in conjunction with the auxiliary side brush assembly described above. Affixed to end support member 113 is visual guide member 70, which provides an easily viewable indication of the height of rotary brush axle 33 above a surface being cleaned. Guide tab 70 rotates about central axis 38 in synchronism with the rotation of offset axle member 36*a* and, hence, also with rotation of rotary brush axle 33 about the central axis. Consequently, guide tab 70 provides a simple brush height adjustment indicator for rotary brush 30. Guide tab 70 is normally viewable by an operation from above sweeper 11 (FIG. 1).

Figure 7:
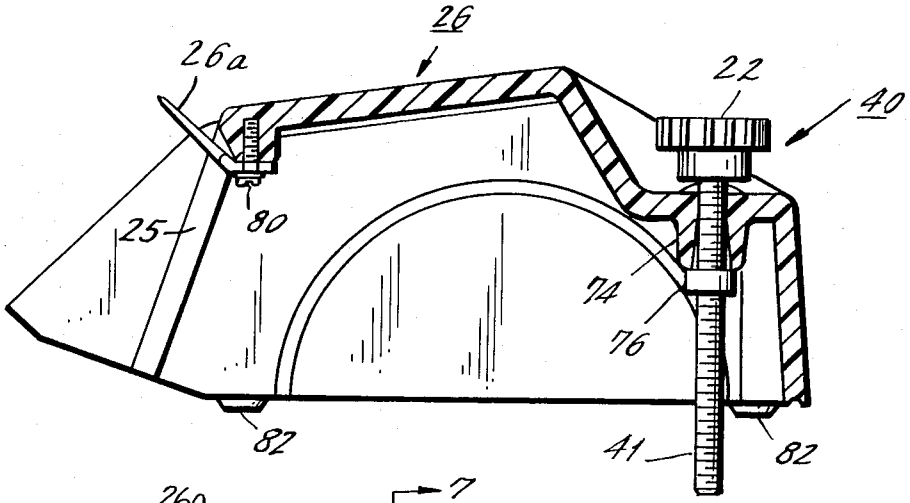
FIG. 7 is a cross-sectional view of the upper housing part shown in FIG. 6 and is taken at arrows 7—7 in FIG. 6.
Figure 6:
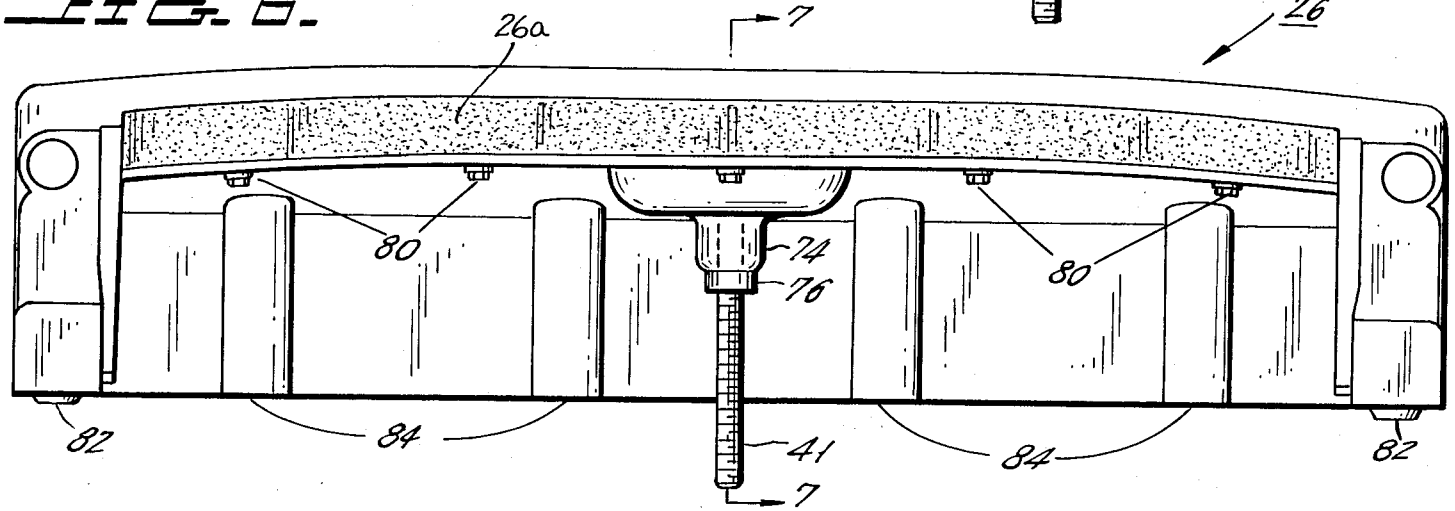
FIG. 6 is a front view of an upper housing part shown in FIG. 3.

FIG. 6 illustrates a front plan view of the upper housing assembly 26, previously shown in FIG. 3, while FIG. 7 shows a cross-sectional view of the upper housing assembly 26 taken at arrows 7—7 in FIG. 6. In FIGS. 6 and 7, pivot mechanism 40 for offset axle portion 36*a* (FIG. 3) is illustrated. Included in pivot mechanism 40 is threaded shank 41 and manually-graspable knob 22 affixed to the upper end of shank 41. Shank 41 passes through a sleeve 74 in housing part 26. Vertical movement of handle 22 with respect to housing part 26 is prevented by means of sleeve 76 placed on shaft 41. Sleeve 76 is affixed to shaft 41 in a conventional manner, such as by inclusion of a threaded screw (not shown) that presses against shank 41 so that the vertical height of shaft 41 above a surface being sweeped remains constant. However, a nut (90 in FIG. 5) coupled to offset axle portion 36*a* moves vertically in response to the turning of knob 22, and thereby effects the pivoting of offset axle portion about central axis 38.

Upper housing part 26 preferably includes an upper dust guard 26*a* of flexible material, which is secured by bolts 80, for example. Upper housing part 26 may also include alignment pins 82, extending downwardly, for facilitating alignment with lower housing part 24 (FIG. 2), which would then be provided with corresponding alignment apertures. Upper housing part 26 may also include vertically oriented sleeves 84 through which mounting bolts (not shown) may pass for securing upper housing part 26 to lower housing part 24.

Figures 8, 8A:
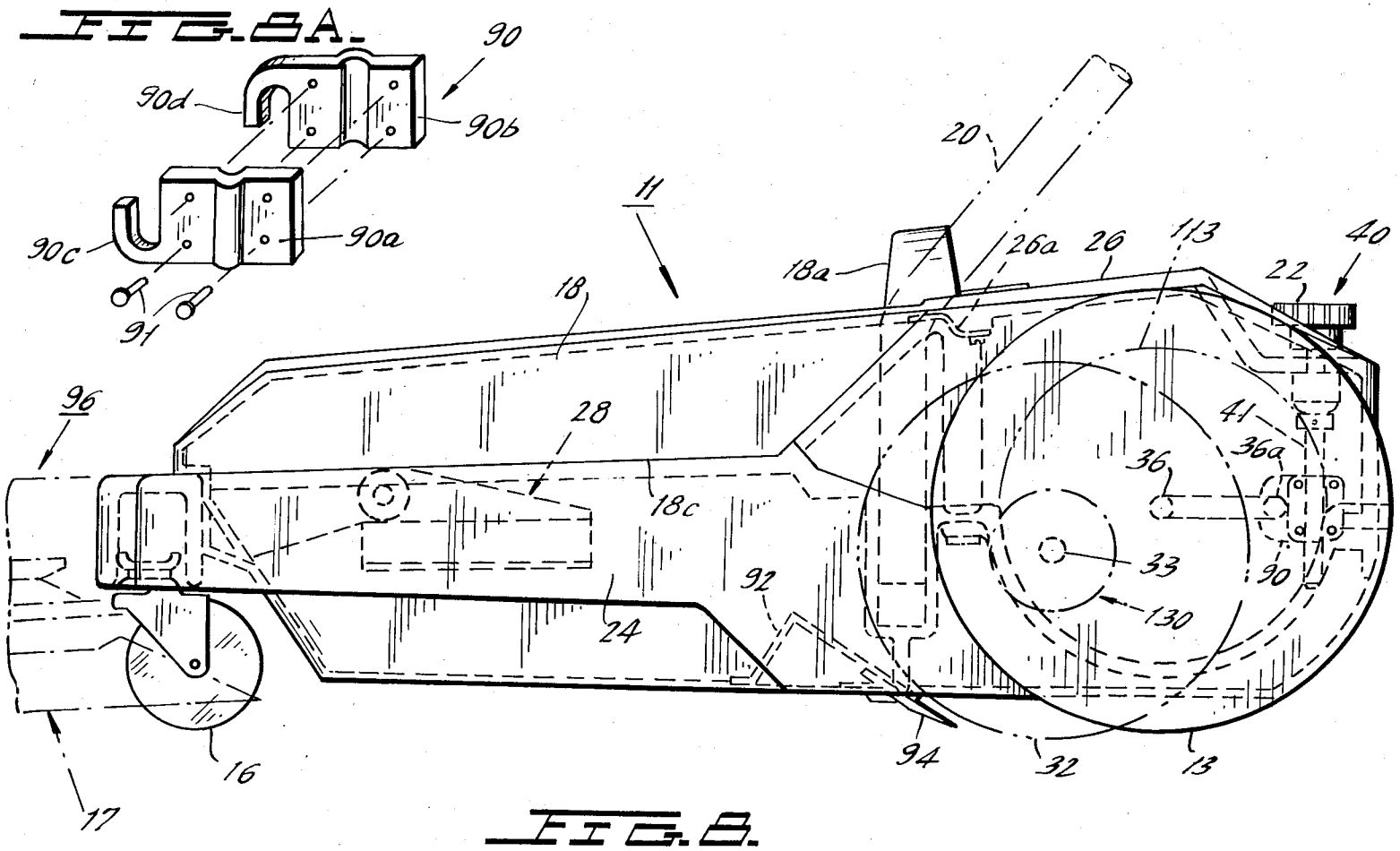
FIG. 8 is a simplified side plan view of the present sweeper illustrating the relative placement of various portions of the sweeper.
FIG. 8A is a detail view of a two-piece separable nut shown at 90 in FIG. 8.

FIG. 8 is a simplified side plan view of sweeper 11 of the present invention, and is useful for observing the relative placement of the various sweeper parts. For example, rotary brush axle 33 can be seen as offset from the center of rear wheel 13. Similarly, offset axle portion 36*a* can be seen to be coupled to threaded shank 41 of pivot mechanism 40 via a nut 90. The detail, exploded view of nut 90 shown in FIG. 8A illustrates special features of the nut. Nut 90 can be seen to include two halves 90*a* and 90*b* which are separable from each other, although they are normally connected to each other via bolts 91. Nut halves 90*a* and 90*b* include contrary-going hooks 90*c* and 90*d*, respectively, which cooperate with each other to grip offset axle portion 36*a*. Due to the inclusion of two-sided nut 90, assembly of sweeper 11 is facilitated since the nut can be assembled at any desired location on threaded shank 41 (FIG. 8).

Preferred features of dust pan 18 are also illustrated in FIG. 8. For example, the lower floor of dust pan 18 includes an upraised portion 92 forming a wall or dam against dirt that would otherwise tend to flow rearwardly towards rotary brush 30. A flexible dust guard 94 is attached to upraised portion 92 to positively direct dirt swept forwardly by brush 32 into the forward portion of debris pan 18. Additionally illustrated generally by numeral 96 is the auxiliary side broom assembly shown in phantom and described further below.

Figure 9:
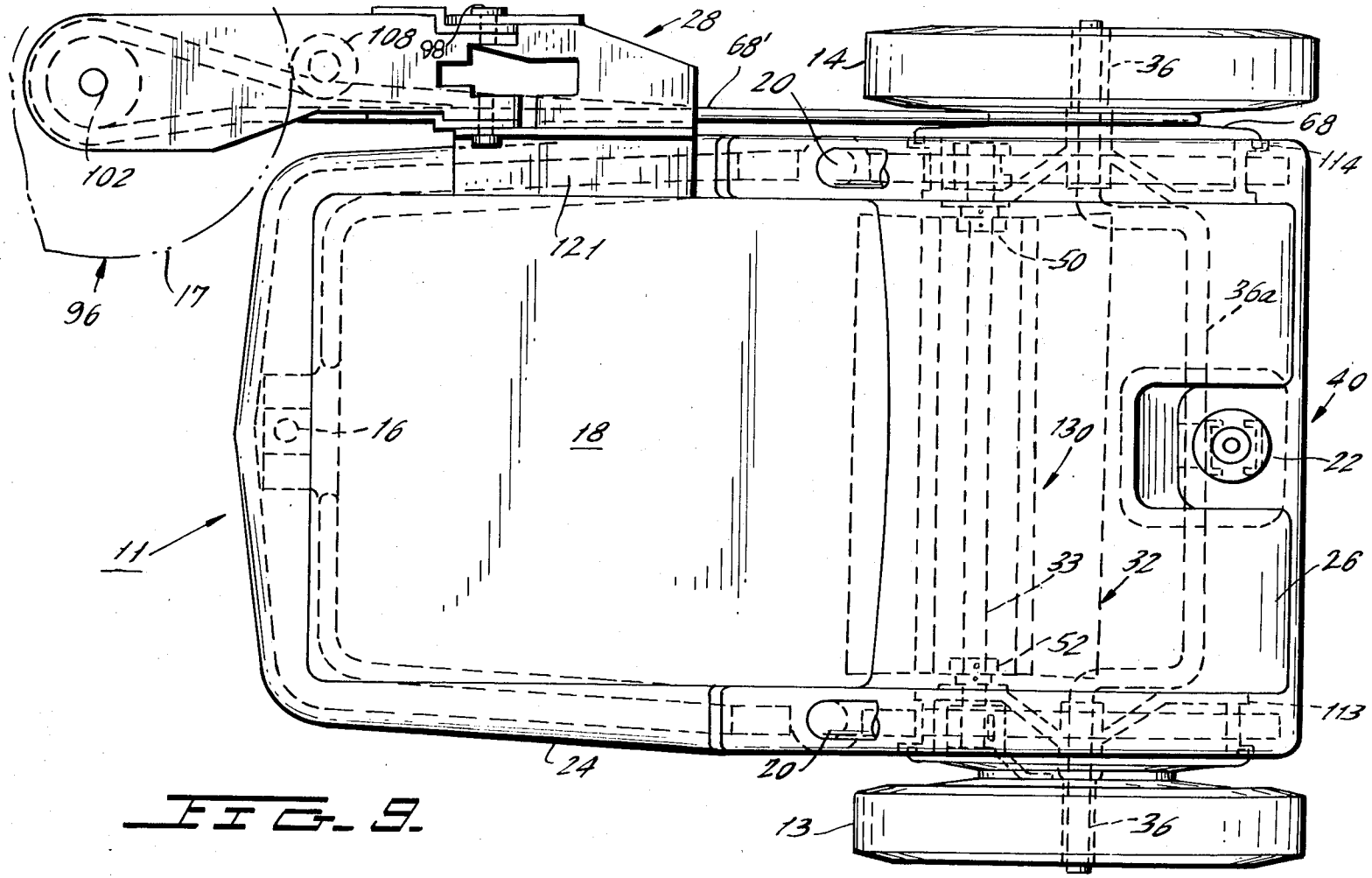
FIG. 9 is a simplified top plan view of the rotary brush sweeper of the present invention illustrating relative locations of various parts of the sweeper.

FIG. 9 is a top plan view of sweeper 11 of the present invention. Again, the offset nature of portion 36*a* of axle 36 is shown as accommodating rotary brush 30 to provide a compact sweeper. A partial upper view of auxiliary side brush 96 is also illustrated. A pivot axle 98 is illustrated, such that a forward portion of brush 96 may lift upwardly, as more clearly depicted in FIG. 2, to be able to ride over obstructions.

Figures 10, 11:
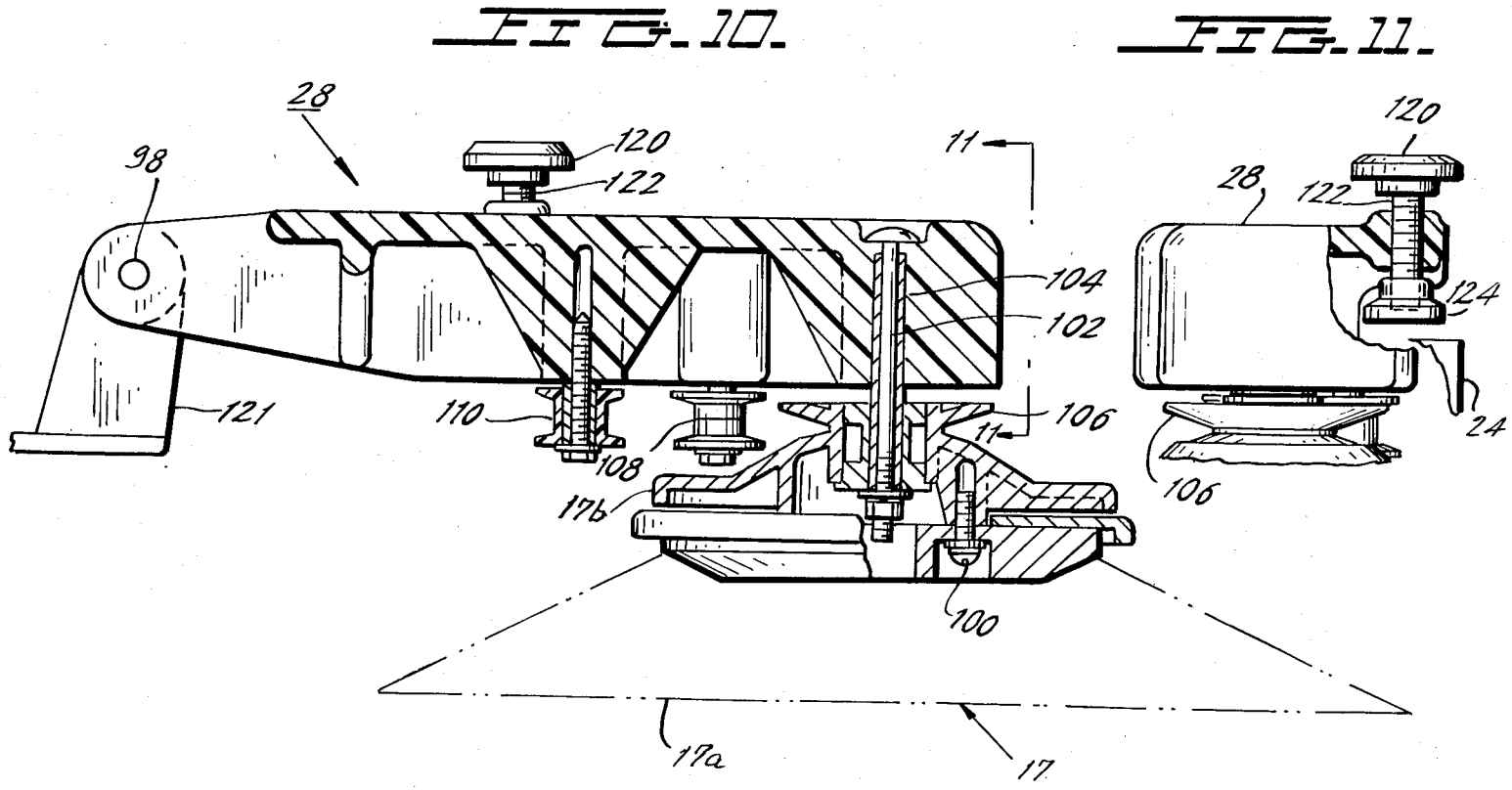
FIG. 10 is a side plan view, partially in cross-section, of the auxiliary rotary brush arrangement of the present invention.
FIG. 11 is a detail view of a height adjustment mechanism for the auxiliary rotary brush of the present sweeper.

FIG. 10 illustrates details of side brush assembly 17 and bracket 28 (FIG. 2), which secures side broom 17 to lower housing part 24. In FIG. 10, the bristle portion 17*a* of the brush is secured to rotatable hub 17*b* via bolts 100. Hub 17*b* is rotatable about shaft 102, which is allowed to spin within sleeve 104 of bracket 28.

Cooperating together are pulley 106 on movable hub part 17*b*, pulleys 108 and 110, depending downwardly from bracket 28, and pulley 68 (FIG. 9) affixed to rear wheel 14, to provide a drive means for brush 17. Pulleys 106, 108 and 110 are arranged in such a way that forward rotation of rear wheel 14 causes counter-clockwise rotation of brush 17*a*, as viewed from above. Adjustment of the height of brush 17*a* above a surface to be cleaned is made possible by height adjustment handle 120, which is affixed to a threaded shank 122. As best shown in FIG. 11, which is taken at arrows 11—11 in FIG. 10, a lower rest 124 affixed to the bottom of threaded shaft 122 is adapted to press against lower housing part 24. Consequently, raising or lowering of auxiliary side brush 17 can be easily accomplished through rotation of adjustment knob 120.

Brush bracket 28 is secured to lower housing 24 by bracket 121 via pivotable connection 98, whereby brush assembly 28 may be upraised as shown in FIG. 2.

Figure 12:
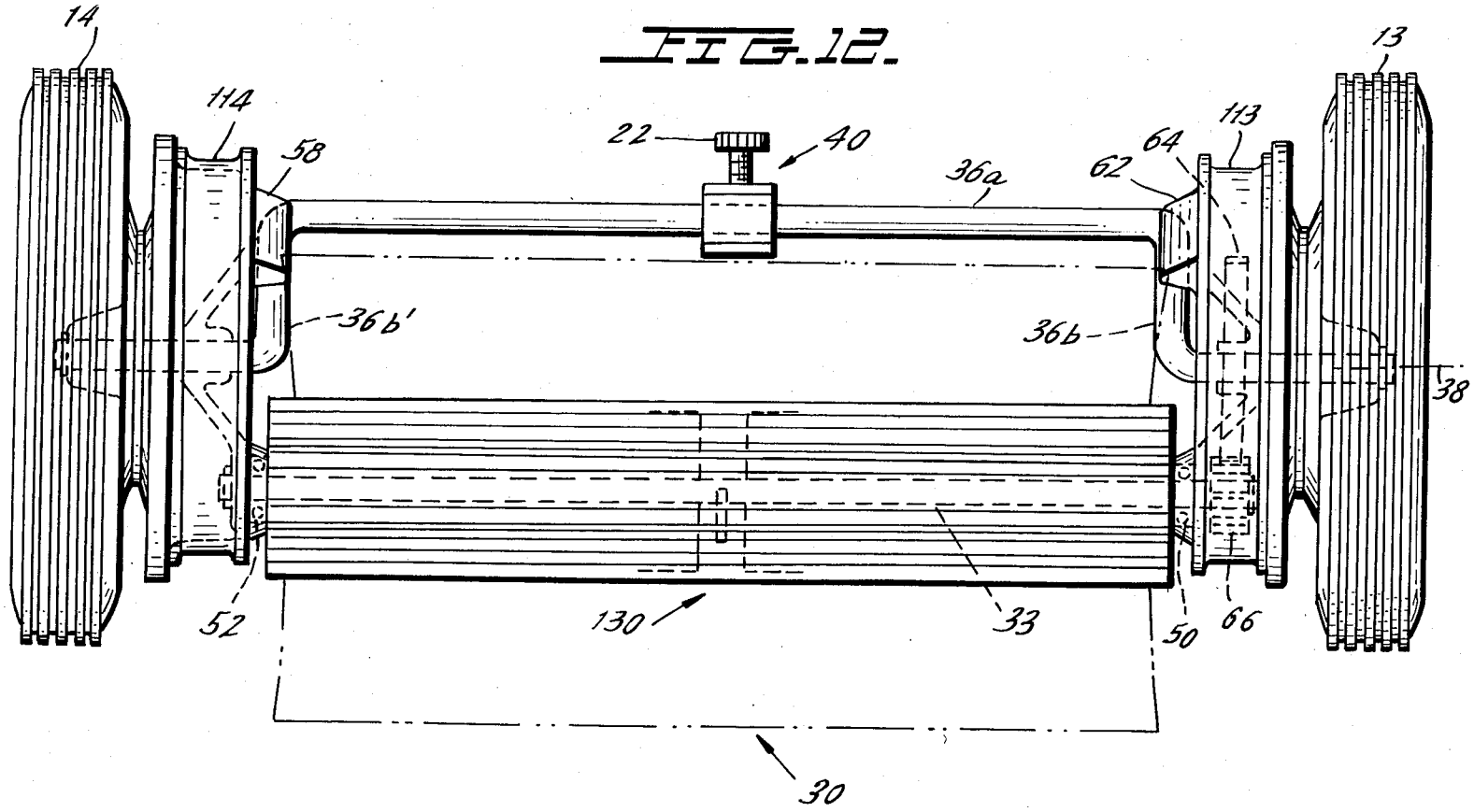
FIG. 12 is a front view of the pivotable brush support assembly of the invention.

FIG. 12 is a front view of brush support assembly 35, together with rear wheels 13 and 14. Bearing 52 for rotary brush 30 can be seen at the left side of rotary brush axle 33. Bearing 50 at the right side of axle 33 is also shown. Pinion gear 66 is illustrated in FIG. 12, and will be elaborated upon with respect to FIG. 13. FIG. 12 also shows grooved elements 58 and 62 which receive axle portions 36*b*′ and 36*b*, respectively, to preserve rotational synchrony of offset axle portion 36*a* and outer hub support members 113 and 114 about central axis 38. Additionally, an inner hub member 130 of rotary brush 30 is depicted in simplified view, and is elaborated upon in FIG. 13.

Figure 14:
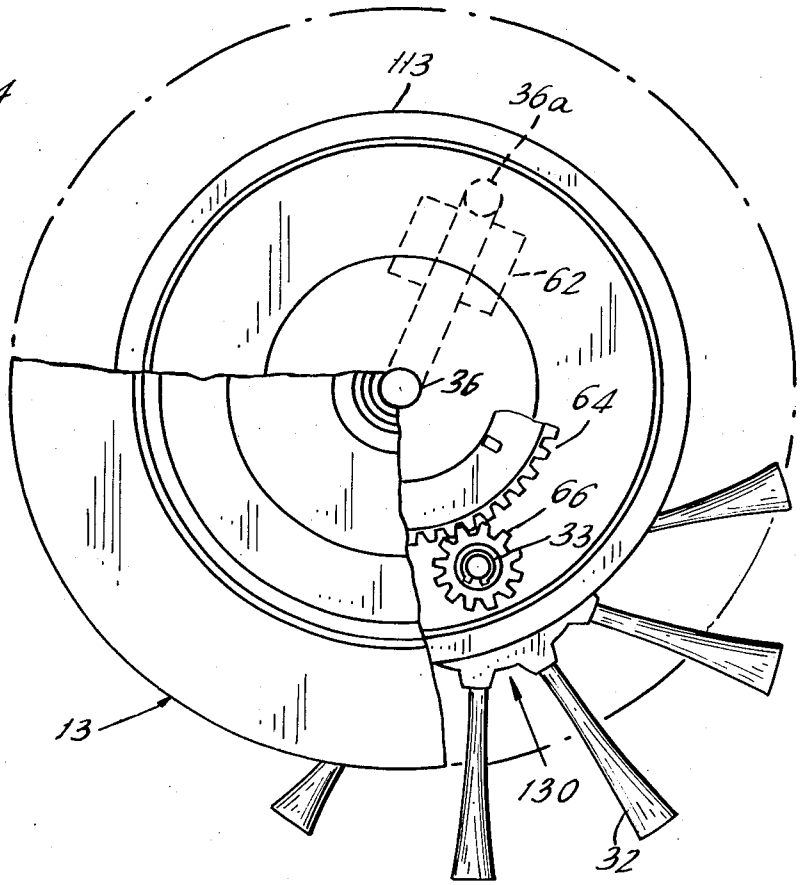
FIG. 14 is a side plan view of the right-hand side of the brush support assembly as viewed in FIG. 12, with the drive wheel removed.
Figure 13:
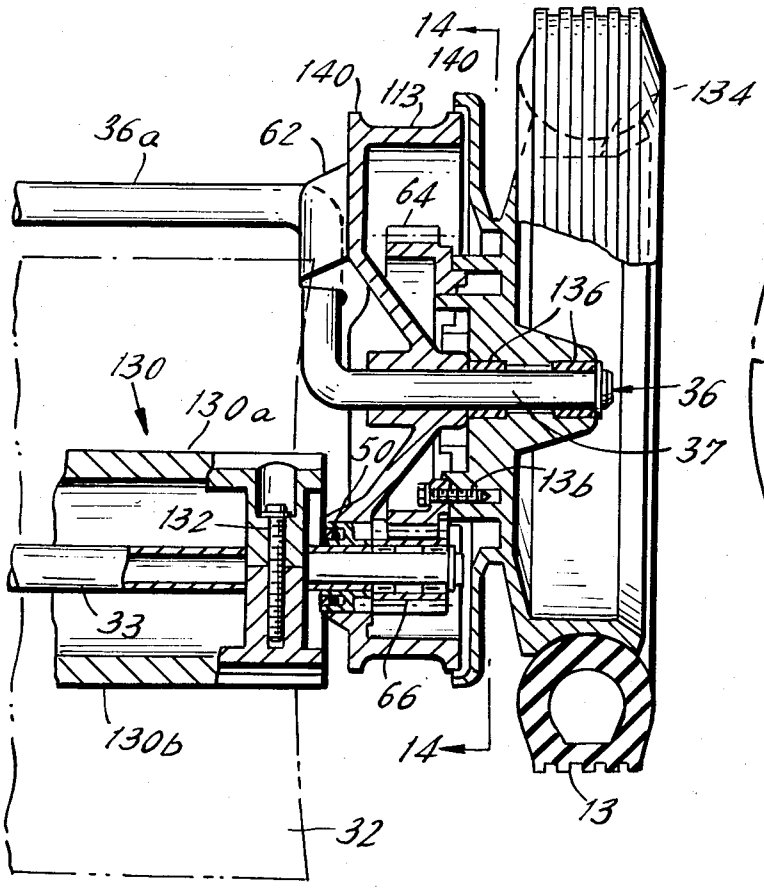
FIG. 13 is a detail view, partially in cross-section, of the driving and bearing mechanisms of the right-hand portion of the brush support assembly of FIG. 12.

Turning to FIG. 13 showing a detail of the assembly of FIG. 12, rotary brush hub 130 can be seen to comprise first and second hub parts 130*a* and 130*b*, which are joined together by bolts 132, for example. Wheel 13 is shown as mounted on a hub 134. Hub 134 in turn, is mounted on axle 36 via bearings 136. Hub 134 includes a ring gear 64 (FIG. 5) secured to the main part of the hub on which wheel 13 is mounted, by bolts 13*b*, for example. FIG. 14 better shows ring gear 64 and is taken at arrows 14—14 in FIG. 13.

Pinion gear 66 is shown in intermeshed relation with ring gear 64 in FIG. 14. As mentioned above, associated with pinion gear 66 is a one-way clutch (not shown), which is included to assure that rotational movement of pinion gear 66 permits rotation of rotary brush 32 in only one direction, i.e. the clockwise direction as viewed in FIG. 14.

FIG. 13 additionally illustrates beads 140 of hub member 113, which are intended to be received within corresponding recesses in upper and lower housing parts 26 and 24, respectively. Hub member 113 is allowed to pivot, as mentioned above, with respect to the upper and lower housing parts. The other hub member 114 correspondingly includes beads (not shown) likewise intended to be received in recesses in the upper and lower housing parts.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A rotary brush sweeper, comprising:

a rotary brush;

means to rotate the rotary brush;

a pivotable brush support assembly including a pair of spaced support members having respective annular convex mounting surfaces; a central axis passing through the spaced support members; the assembly supporting the rotatable brush about a brush axis which is radially offset from the central axis such that rotation of the assembly about the central axis raises or lowers the rotary brush with respect to the central axis;

means to rotate the pivotable brush support assembly; and a housing including a pair of annular concave mounting surfaces for respectively receiving the pair of annular convex mounting surfaces of the pivotable brush support assembly.

2. The rotary brush sweeper of claim 1, wherein the pivotable brush support assembly includes an axle means with first and second wheel support portions protruding outwardly from the brush support assembly along the central axis thereof, and further comprising first and second wheels which are respectively mounted on the first and second wheel support portions.

3. The rotary brush sweeper of claim 2, wherein the rotation means for the brush support assembly includes:

an offset axle member being connected to the first and second wheel support portions, being integrally joined to the brush support assembly so as to be pivotable in synchrony therewith about the central axis; and a pivot means for pivoting the offset axle portion with respect to the housing.

4. The rotary brush sweeper of claim 3, wherein the pivot means comprises a coupling member coupled to the offset axle portion and means for rotating the coupling member in arcuate fashion about the central axis to thereby effect pivoting of the brush support assembly.

5. The rotary brush sweeper of claim 4, wherein the rotating means comprises a threaded shank, and wherein the coupling member includes a threaded aperture for receiving the threaded shank.

6. The rotary brush sweeper of claim 5, wherein the coupling member comprises first and second separable nut halves which may be joined to each other at any point along the threaded shank to facilitate assembly of the sweeper.

7. The rotary brush sweeper of claim 6, wherein the separable halves of the coupling member each include a contrary going arm configured to respectively hold upper and lower portions of the offset axle portion.

8. The rotary brush sweeper of claim 1, further including a second rotary brush having a brush portion oriented vertically downwardly in the shape of a skirt that is directed outwardly at the bottom.

9. The rotary brush sweeper of claim 8, further including a pivotable support mechanism for the second rotary brush permitting the second brush to be moved upwardly from the surface being cleaned whereby, for example, damage to the second rotary brush from impact with an obstacle is avoided.

10. The rotary brush sweeper of claim 1, wherein:

the rotary brush comprises an axle aligned with the brush axis;

the pivotable brush support assembly includes a pinion gear for imparting rotational movement to the brush axle and a one-way clutch for assuring that the rotary brush rotates in solely a single direction; and the rotary brush sweeper includes means for rotating the pinion gear.

11. The rotary brush sweeper of claim 1, further including a debris pan located forwardly of the rotary brush and supported by the housing, the debris pan having an opening at its rear portion facing the rotary brush.

12. The rotary brush sweeper of claim 1, wherein the rotary brush comprises a generally cylindrical rotary brush rotatable about the brush axis.

13. The rotary brush sweeper of claim 1, further comprising a visual indicator of the height of the rotary brush above a surface to be cleaned.

14. The rotary brush sweeper of claim 13, wherein the visual indicator comprises a tab protruding from one of the spaced support members of the pivotable brush support assembly.

15. A rotary brush sweeper, comprising:

a rotary brush of generally cylindrical form rotatable about a brush axle;

means to rotate the rotary brush;

a pivotable brush support assembly;

means to rotate the pivotable brush support assembly;

the pivotable brush support assembly including a pair of spaced disc-like support members having respective annular convex mounting surfaces, with a central axis passing through the centers of the spaced support members;

the assembly supporting the rotary brush axle in a position radially offset from the central axis and between the spaced support members, such that rotation of the assembly about the central axis raises or lowers the rotary brush with respect to the central axis;

a housing including a pair of annular concave mounting surfaces for respectively receiving the pair of spaced support members of the pivotable brush support assembly; and a debris pan supported by the housing forwardly of the rotary brush.

16. The rotary brush sweeper of claim 15, wherein the rotation means for the brush support assembly includes:

an axle having outer ends aligned with the central axis of the assembly and including an intermediate portion offset from the central axis; and means for pivoting the offset axle portion about the central axis.

17. The rotary brush sweeper of claim 15, further comprising a means for visually indicating the height of the brush axle above a surface to be cleaned.

18. The rotary brush sweeper of claim 17, wherein the visual indicating means comprises a tab affixed to the pivotable brush support assembly at a radially outer location with respect to the central axis.

* * * * *